US006417815B2

(12) United States Patent
Moheb

(10) Patent No.: US 6,417,815 B2
(45) Date of Patent: Jul. 9, 2002

(54) ANTENNAS AND FEED SUPPORT STRUCTURES HAVING WAVE-GUIDES CONFIGURED TO POSITION THE ELECTRONICS OF THE ANTENNA IN A COMPACT FORM

(75) Inventor: Hamid Moheb, Clemmons, NC (US)

(73) Assignee: Prodelin Corporation, Conover, NC (US)

( * ) Notice: Subject to any disclaimer, the term of this patent is extended or adjusted under 35 U.S.C. 154(b) by 0 days.

(21) Appl. No.: 09/797,012

(22) Filed: Mar. 1, 2001

Related U.S. Application Data

(60) Provisional application No. 60/186,245, filed on Mar. 1, 2000.

(51) Int. Cl.[7] ..... H01Q 13/00

(52) U.S. Cl. ..... 343/772; 343/781 R; 343/786; 333/21 A

(58) Field of Search ..... 343/772, 781 P, 343/781 CA, 781 R, 786, 840, 912, DIG. 2; 333/21 A, 135, 137; H01Q 13/00

(56) References Cited

U.S. PATENT DOCUMENTS

| | | | | |
|---|---|---|---|---|
| 4,008,477 A | | 2/1977 | Babij et al. | |
| 4,224,622 A | * | 9/1980 | Schmidt | 343/840 |
| 4,607,260 A | | 8/1986 | Dragone | |
| 4,608,573 A | * | 8/1986 | Paullin | 343/894 |
| 4,821,046 A | | 4/1989 | Wilkes | |
| 4,901,369 A | * | 2/1990 | Momose et al. | 455/84 |
| 5,136,294 A | | 8/1992 | Iwata | |
| 5,216,432 A | | 6/1993 | West | |
| 5,276,410 A | * | 1/1994 | Fukuzawa et al. | 333/21 A |
| 5,309,167 A | | 5/1994 | Cluniat et al. | |
| 5,420,599 A | | 5/1995 | Erkocevic | |
| 5,434,586 A | | 7/1995 | Kimoshita et al. | |
| 5,459,441 A | | 10/1995 | Weber et al. | |
| 5,463,406 A | | 10/1995 | Vannatta et al. | |
| 5,463,407 A | | 10/1995 | West et al. | |
| 5,495,258 A | | 2/1996 | Muhlhauser et al. | |
| 5,534,881 A | | 7/1996 | Young et al. | |
| 5,550,554 A | | 8/1996 | Erkocevic | |
| 5,578,972 A | | 11/1996 | Tilford | |
| 5,606,334 A | * | 2/1997 | Amarillas et al. | 343/840 |
| 5,686,923 A | | 11/1997 | Schaller | |

(List continued on next page.)

OTHER PUBLICATIONS

Gilat–To–Home 75E Instruction and Assembly Instructions, pp. 1–23, (Aug. 2000).*

Channel Master Advertisement in Via Satellite Journal Publication, 2 pages (Jan. 2001).*

Channel Master Model 6110TOS Assembly Instructions (Mar. 1994).*

Channel Master Model 6110TN Mounting Instructions, 2 pages, (Jan. 1995).*

*Primary Examiner*—Tho G. Phan
(74) *Attorney, Agent, or Firm*—Alston & Bird LLP

(57) ABSTRACT

The present invention provides various wave-guides and support structures that are used in conjunction with feed structures to form compact antennas. Specifically, in one embodiment, the present invention provides a wave-guide design used for connecting the feed of an antenna to various electronics, such as a transmitter or receiver. The wave-guide of this embodiment includes a first end for connecting to the feed and a second end for connection to either a transmitter, receiver, or other electronic components. Importantly, the body of the wave-guide extends in a direction towards the reflector of the antenna so that the second end of the wave-guide is positioned closer to the reflector than the first end of the wave-guide. As such, the transmitter or receiver that is connected to the second end of the wave-guide is located in close relationship with the reflector, thereby creating a compact, aesthetically pleasing antenna structure.

19 Claims, 8 Drawing Sheets

U.S. PATENT DOCUMENTS 5,686,926 A 11/1997 Kijima et al.
5,737,698 A 4/1998 Gabrelian et al.
5,805,116 A 9/1998 Morley
5,812,096 A 9/1998 Tilford
5,831,582 A 11/1998 Muhlhauser et al.
5,870,062 A * 2/1999 Cox ..... 343/781 R
6,018,276 A 1/2000 Hirota et al.
6,031,505 A 2/2000 Qi et al.
D431,555 S * 10/2000 Cronin et al. ..... D14/230

* cited by examiner

ANTENNAS AND FEED SUPPORT STRUCTURES HAVING WAVE-GUIDES CONFIGURED TO POSITION THE ELECTRONICS OF THE ANTENNA IN A COMPACT FORM

CROSS-REFERENCE TO RELATED APPLICATIONS

The present application claims priority from U.S. Provisional Application Ser. No. 60/186,245 entitled MULTI-BEAM ANTENNA FOR TRANSMITTING AND/OR RECEIVING SIGNALS FROM MULTIPLE TRANSMISSION AND RECEIVING SOURCES THAT ARE LOCATED IN CLOSE PROXIMITY TO EACH OTHER, filed Mar. 1, 2000, the contents of which are incorporated herein by reference.

FIELD OF THE INVENTION

The present invention relates generally to an antenna, and more particularly to an antenna for transmitting or receiving signals to or from one or more satellites.

BACKGROUND OF THE INVENTION

For many years, satellite communication systems were typically used only in industrial and military applications, with little use in the general private sector. However, in recent years, there has been a significant increase in the amount and types of information that is transmitted via satellite communication for individual consumer use. For instance, satellites now transmit telephone signals, television signals, and Internet data, etc. Due to the increased amount of information and services offered via satellite communication for individual consumer use, there has been an associated need for antennas designed with the individual user in mind.

Specifically, many of the antennas used for commercial and military-based applications are typical large structures having large aperture reflectors and rather large, high power transmitters. As private sector antennas are used mainly in residential setting, the size and associated cost of these large aperture antennas generally make them impractical for individual consumer applications. As such, as satellite communication continually moves to the private sector, there exists an increased need to provide antennas that are both compact and aesthetically pleasing for residential installation.

For this reason, small aperture antennas have been developed that use smaller reflector configurations and smaller transmitters. These small aperture antennas are generally small enough to be used in residential settings. They are also typically cost effective. However, many current small aperture antenna designs, have some drawbacks that may not only unnecessarily increase their size but may also increase stress in the antenna structure.

For example, FIG. 1 illustrates a typical antenna system 10 used to establish communication with a satellite. The antenna system includes a reflector 12 for directing at a satellite, not shown, to receive signals from the satellite and provide these signals in a focused manner to a feed 14 positioned in front of the reflector. Further, the reflector may also direct signals from the feed to the satellite. The reflector is connected to the ground or other type of stationary structure by a mounting post 16, and the feed 14 is connected to the reflector via a boom arm 18. Importantly, the antenna also includes electronics 20 such as a low noise block and/or transmitter connected to the feed. The low noise block is used to filter and amplify signals received by the feed from the satellite prior to application to a receiver unit. Further, the transmitter provides signals to the feed for transmission to the satellite.

As illustrated in FIG. 1, a drawback with many antenna designs is that the transmitter and/or receiver components 20 are typically placed in an in-line configuration behind the feed 14. This in-line configuration may result in an enlarged component packaging for the antenna. In other words, the distance D between the reflector 12 and the distal portion of the antenna opposite the reflector is increased by the placement of the transmitter and/or receiver electronics in an in-line configuration behind the feed. This, in turn, may not only increase the size of the antenna but may also decrease the aesthetic value of the antenna.

An additional problem with the conventional antenna design illustrated FIG. 1 is that the in-line configuration of the transmitter and/or receiver may also increase the load on the boom arm and mounting post of the antenna. Specifically, the further the distance D the transmit and receive electronics are from the reflector, the greater the moment force M on the boom arm 18 and mounting post 16. These moment forces may cause stress in the boom arm and mounting post structures and under some conditions, such as high winds or heavy snow, may cause failure. In light of this, an antenna having a more compact configuration may be desired, not only for private sector use, but also for industrial and military applications.

SUMMARY OF THE INVENTION

As set forth below, the present invention provides various antennas, support apparatus, and wave-guides that overcome many of the identified deficiencies and several additional deficiencies associated with providing an antenna having a compact configuration and decreased moment stress on the antenna structure. According to the present invention, an antenna is provided having a compact feed structure such that either one or both the receiver and transmitter electronics associated with the antenna are more closely spaced with respect to the reflector of the antenna. This compact structure may decrease the overall size of the antenna and also reduce moment forces on the boom arm and mounting post of the antenna.

Specifically, in one embodiment, the present invention provides a novel wave-guide design used for connecting the feed of an antenna to various electronics, such as a transmitter or receiver. The wave-guide of this embodiment includes a first end for connecting to the feed and a second end for connection to either a transmitter, receiver, or other electronic components. Importantly, the body of the wave-guide extends in a direction towards the reflector of the antenna so that the second end of the wave-guide is positioned closer to the reflector than the first end of the wave-guide. As such, the transmitter or receiver that is connected to the second end of the wave-guide is located in closer relationship with the reflector, thereby creating a compact, aesthetically pleasing antenna structure. Further, because the transmitter or receiver is located proximal to the reflector, the moment forces on the mounting post and boom arm of the antenna are reduced over prior art antenna designs.

For example, in one embodiment of the present invention, the feed of the antenna has a proximal end directed at the reflector of the antenna and a distal end directed away from the reflector of the antenna. In this embodiment, the first end of the wave-guide of the present invention has an end surface oriented toward the reflector for connecting to the distal end of the feed. The end surface of the wave-guide defines a plane which is spaced forwardly of the reflector. In this embodiment, at least a portion of the body of the wave-guide extends towards the reflector and is projected beyond the plane. More specifically, in one embodiment, the second end of the wave-guide projects beyond the plane.

In one embodiment, to make the antenna more compact, the body of the wave-guide of the present invention extends along an axis of extension at an offset angle that is less than 90 degrees with respect to an axis extending between the proximal and distal ends of the feed. This angle of offset directs the second end of the wave-guide back toward the reflector, such that the transmitter or receiver connected to the second end of the wave-guide is proximal to the reflector.

In another embodiment, the wave-guide of the present invention has a body with two sections. Specifically, the first body portion of the wave-guide is connected to the feed by the first end of the wave-guide. The first body portion has an axis of extension such that the first body portion extends from the first end of the wave-guide at a first offset angle with respect to an axis extending between the proximal and distal ends of the feed. At the end of the first body portion of the wave-guide is a bend portion. Connected to the bend portion is a second body portion that has a second axis of extension. This second axis of extension extends at a second offset angle from the first axis of extension of the first body portion towards the reflector of the antenna.

As an example, in one embodiment, the first body portion of the wave-guide of the present invention extends from feed at a first offset angle of 90 degrees. Further, in this embodiment of the wave-guide of the present invention, the second body portion of the wave-guide extends along a second axis at an offset angle with respect to the first body portion at angle in the range of greater than 0 degrees and less than 180 degrees. In this configuration, the second end of the wave-guide is closer to the reflector of the antenna than the first end of the wave-guide. As such, any electronic component connected to the second end of the wave-guide, such as a transmitter or reflector, are proximate to the reflector.

As mentioned above, the wave-guide of the present invention can be used as either a transmit or receive wave-guide depending on the particular application. For example, in one embodiment of the present invention, the wave-guide is a receive wave-guide having a first end connected to the feed and a second end connected to a receiver, such as a low noise block. As before, in this embodiment, the second end of the wave-guide extends toward the reflector of the antenna, such that the receiver is located proximal to the reflector. In an alternative embodiment, the wave-guide of the present invention is a transmit wave-guide with a transmitter connected to the second end of the wave-guide, such that the transmitter is proximal to the reflector of the antenna.

In some embodiments, the present invention further provides an apparatus for coupling at least one of a transmitter and a receiver to a feed of an antenna. The apparatus includes a support structure that has a first port for connection to the feed and a second port for connection to either a receiver or a transmitter. In this embodiment, the first end of the wave-guide of the present invention is connected to the second port of the support structure and the second end is connected to either a transmitter or receiver and extends toward the reflector of the antenna.

Importantly, in one embodiment, the feed associated with the support structure of the present invention is used for two-way communication with a satellite, such that the feed both receives signals from and transmits signals to the satellite. In this embodiment, the support structure of the present invention is an ortho-mode transducer capable of receiving signals from and providing transmit signals to the feed. The support structure of this embodiment of the present invention includes a first port for connection to the feed, a second port for connection with a transmitter, and a third port for connection to a receiver.

In this embodiment, the present invention further includes a transmit wave-guide connected between the second port of the support structure and a transmitter and a receive wave-guide connected between the third port of the support structure and a receiver. In this configuration, at least one of the wave-guides has a body that extends toward the reflector of the antenna such that at least a portion of the body of the wave-guide extends past the first end of the wave-guide to thereby position the transmitter or receiver connected to the wave-guide proximal to the reflector of the antenna. In one further embodiment, both the transmit and receive wave-guides extend toward the reflector of the antenna such that both the receiver and the transmitter are proximal to the reflector.

The present invention also provides an antenna that incorporates the wave-guide of the present invention. Specifically, according to one embodiment, the antenna includes a reflector and feed connected to each other by a boom arm. The antenna further includes a wave-guide having a first end connected to the feed and either a transmitter, a receiver, or other component connected to the second end of the wave-guide. The second end of the wave-guide extends toward the reflector such that the transmitter or receiver connected to the wave-guide is positioned proximal to the reflector. In this embodiment, because the transmitter or receiver is located proximal to the reflector, the moment forces on the boom arm connecting the feed to the reflector are reduced over prior art configurations.

In one advantageous embodiment, the antenna further includes either a transmitter or receiver connected to the boom arm of the antenna. In this embodiment, the wave-guide connecting the transmitter or receiver to the feed, extends from the feed to the wave-guide.

BRIEF DESCRIPTION OF THE DRAWINGS

Figure 1:
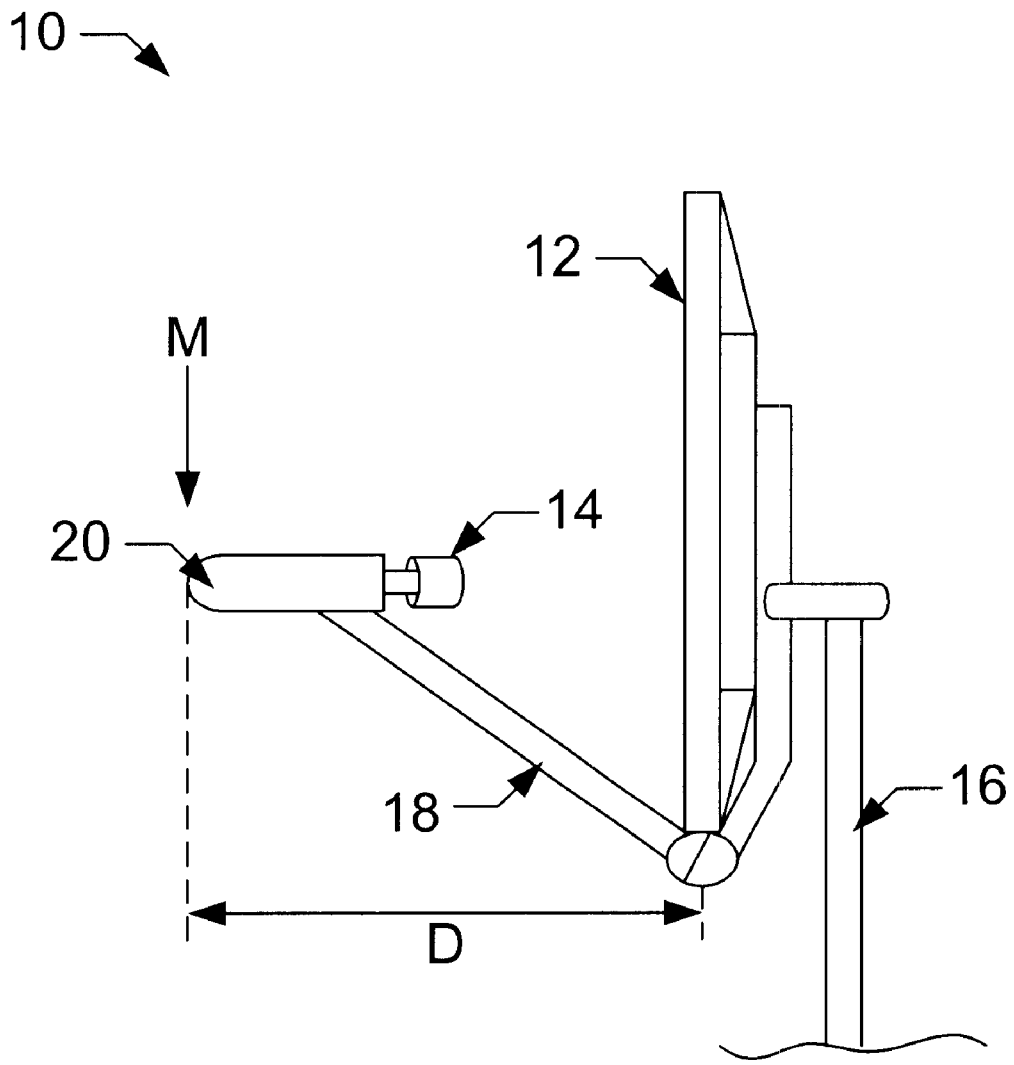
Figure 1 (Prior Art)

Having thus described the invention in general terms, reference will now be made to the accompanying drawings, which are not necessarily drawn to scale, and wherein:

FIG. 1 is a general side view of an antenna including a reflector and feed structure with in-line placement of electronics according to prior art designs.

Figure 2A:
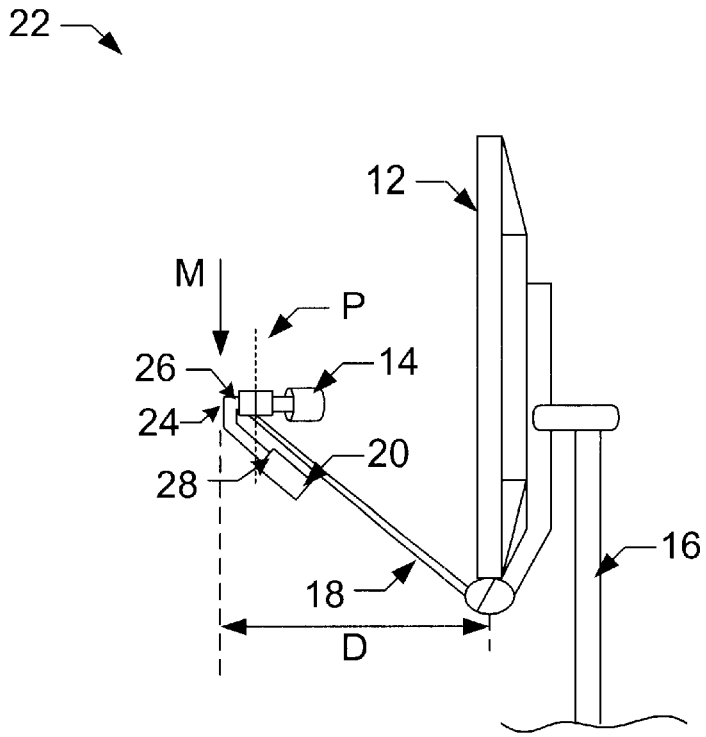

FIG. 2A is a general side view of the wave-guide in conjunction with an antenna of the present invention directed downwardly and toward the reflector of an antenna according to one embodiment of the present invention.

Figure 2B:
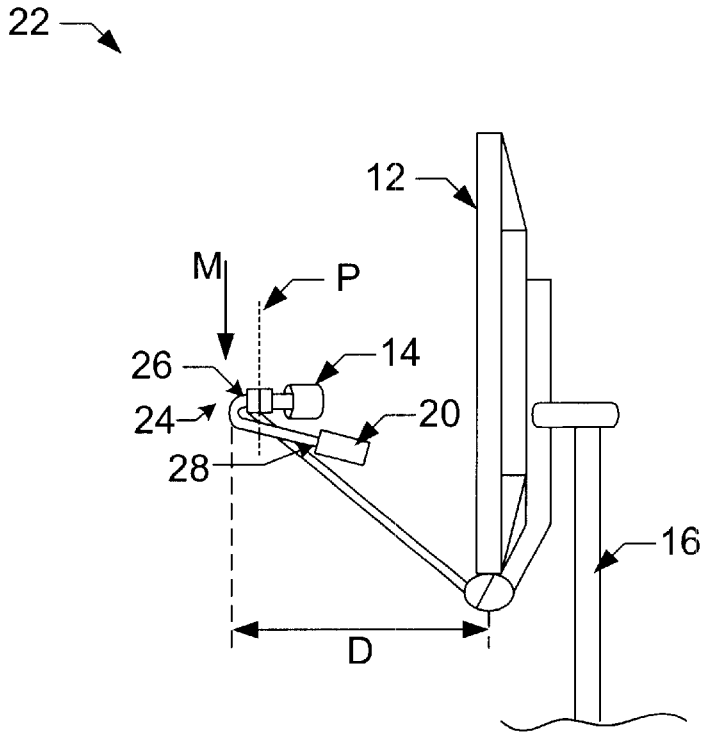
Figure 2C:
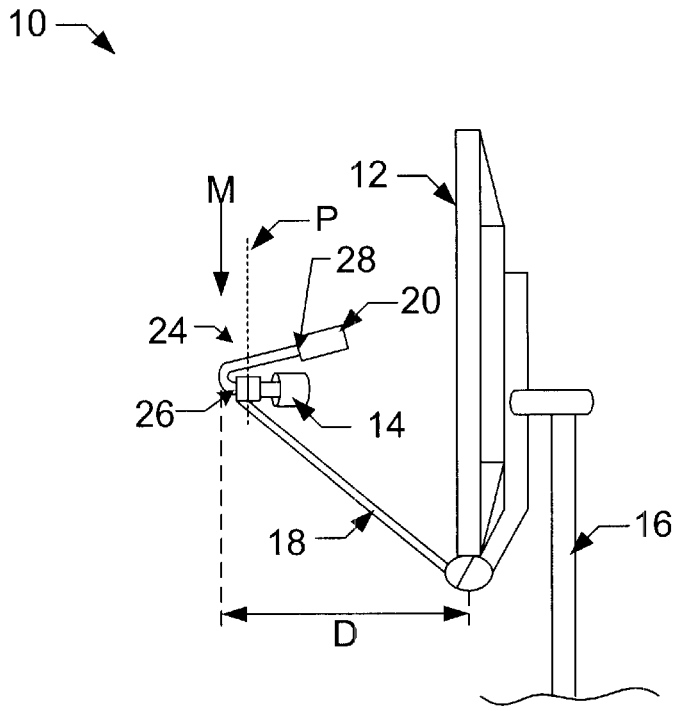

FIGS. 2B and 2C are general side views of the wave-guide in conjunction with an antenna of the present invention respectively illustrating extension of the wave-guide in an upward and side direction toward the reflector of an antenna according to one embodiment of the present invention.

Figure 2D:
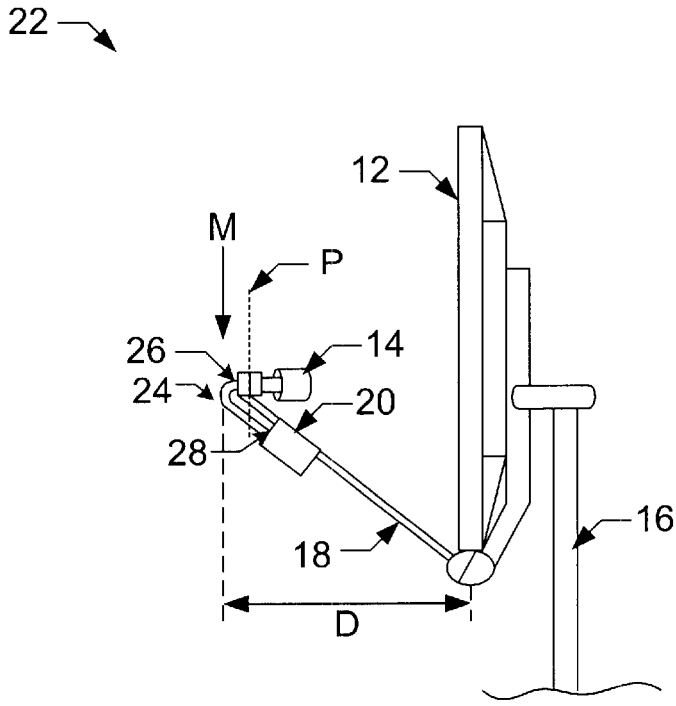

FIG. 2D is a general side view of the wave-guide in conjunction with an antenna of the present invention in which electronics associated with the antenna are connected to the boom arm of the antenna and the wave-guide is directed downwardly and toward the reflector of the antenna according to one embodiment of the present invention.

Figure 2E:
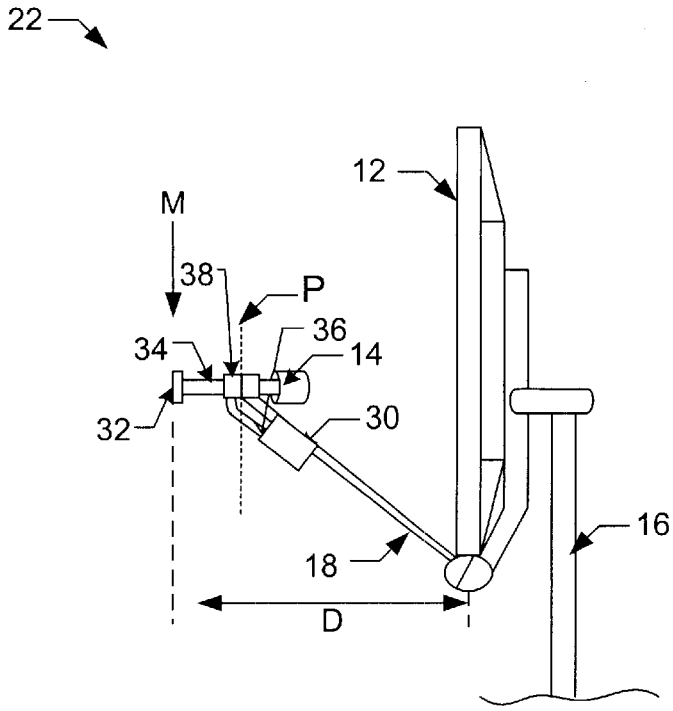

FIG. 2E is a general side view of the wave-guide in conjunction with an antenna and feed support structure of the present invention respectively illustrating connection of two wave guides to a feed used for both transmission and reception, where both of the wave-guides extend toward the reflector of the antenna according to one embodiment of the present invention.

Figure 2F:
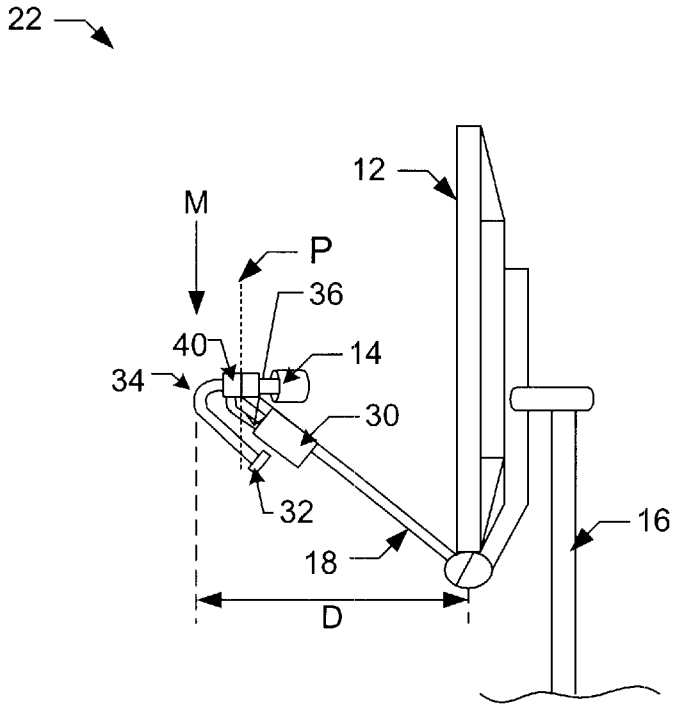

FIG. 2F is a general side view of the wave-guide in conjunction with an antenna and feed support structure of the present invention respectively illustrating connection of two wave guides to a feed used for both transmission and reception, where one of the wave-guides extends toward the reflector of the antenna according to one embodiment of the present invention.

Figure 3:
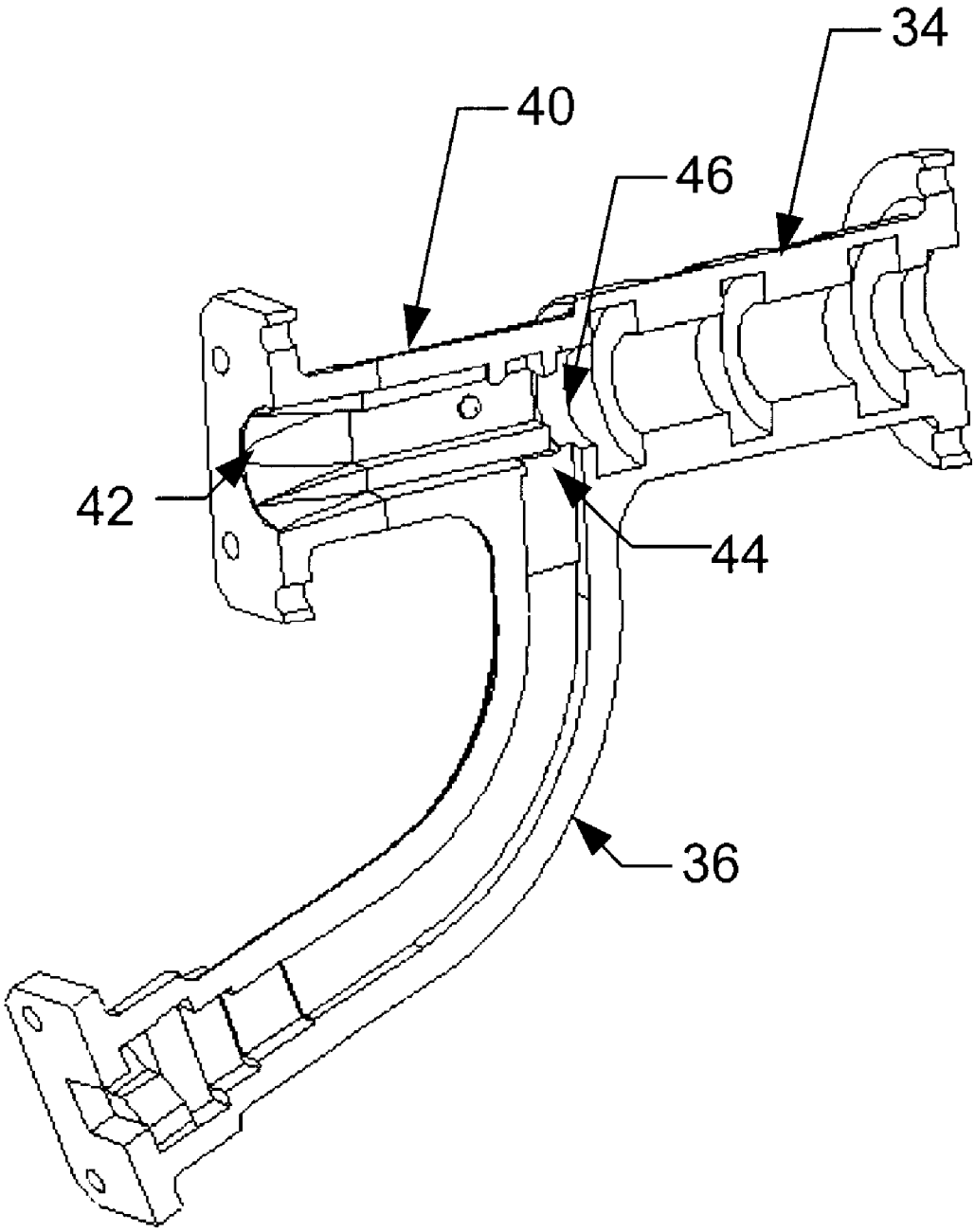

FIG. 3 is a perspective cross-sectional view of a support structure in combination with wave-guides of the present invention for connection to a feed that both transmits and receives according to one embodiment of the present invention.

Figure 4A:
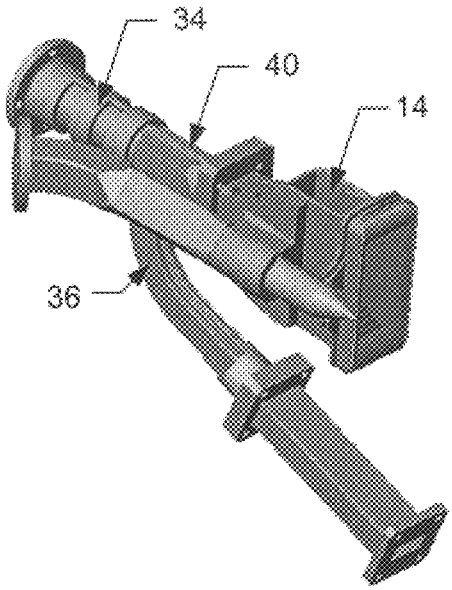
Figure 4B:
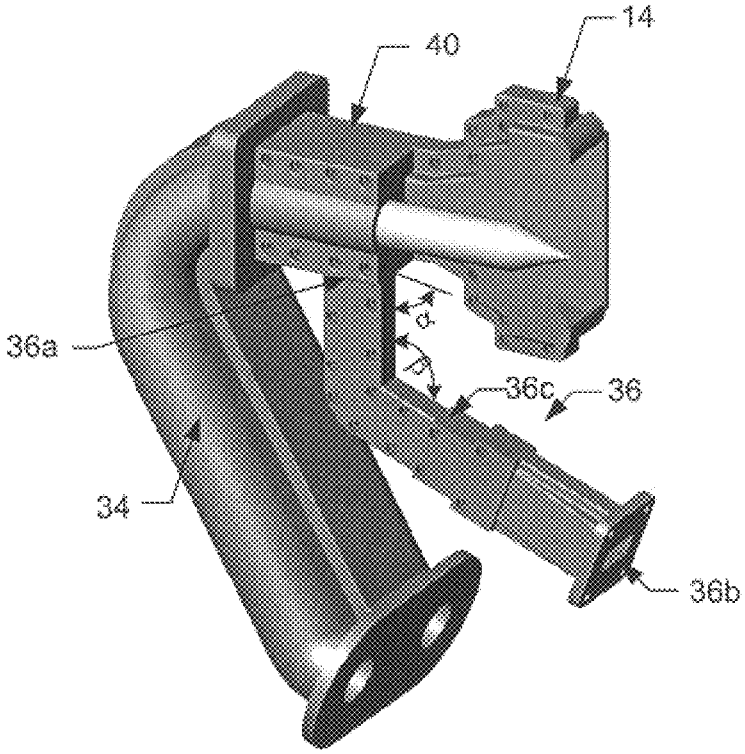

FIGS. 4A and 4B are perspective views of a support structure in combination with wave-guides of the present invention for connection to a feed that both transmits and receives according to one embodiment of the present invention.

Figure 5A:
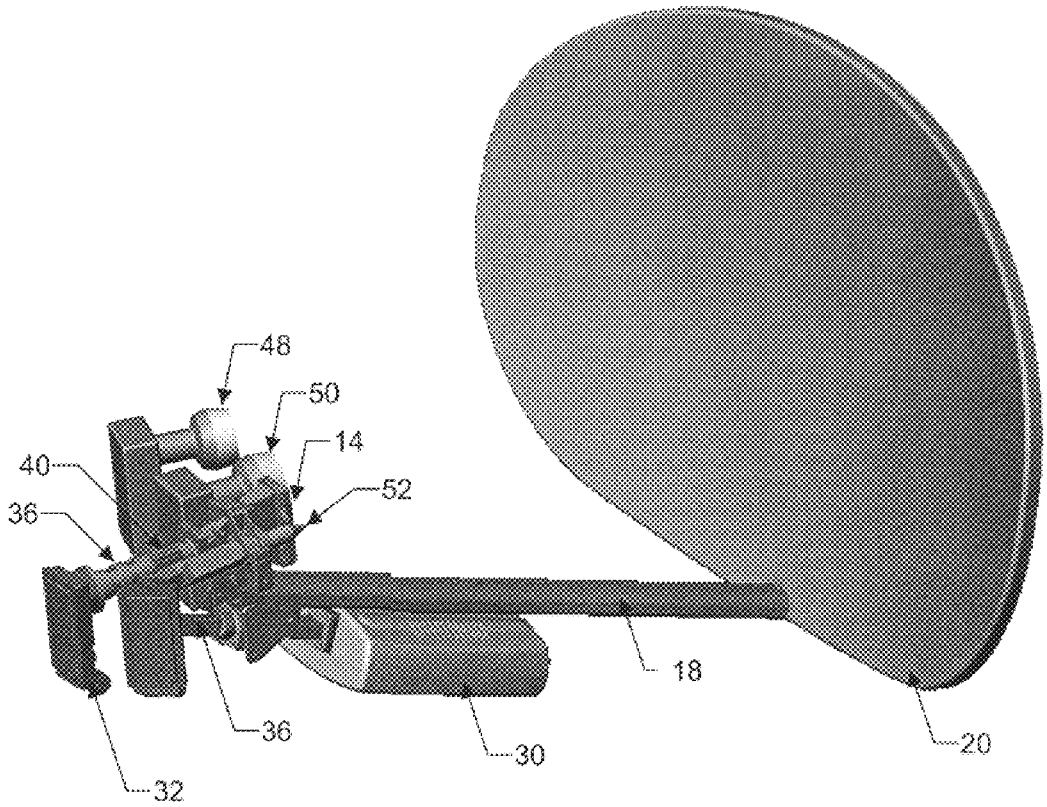
Figure 5B:
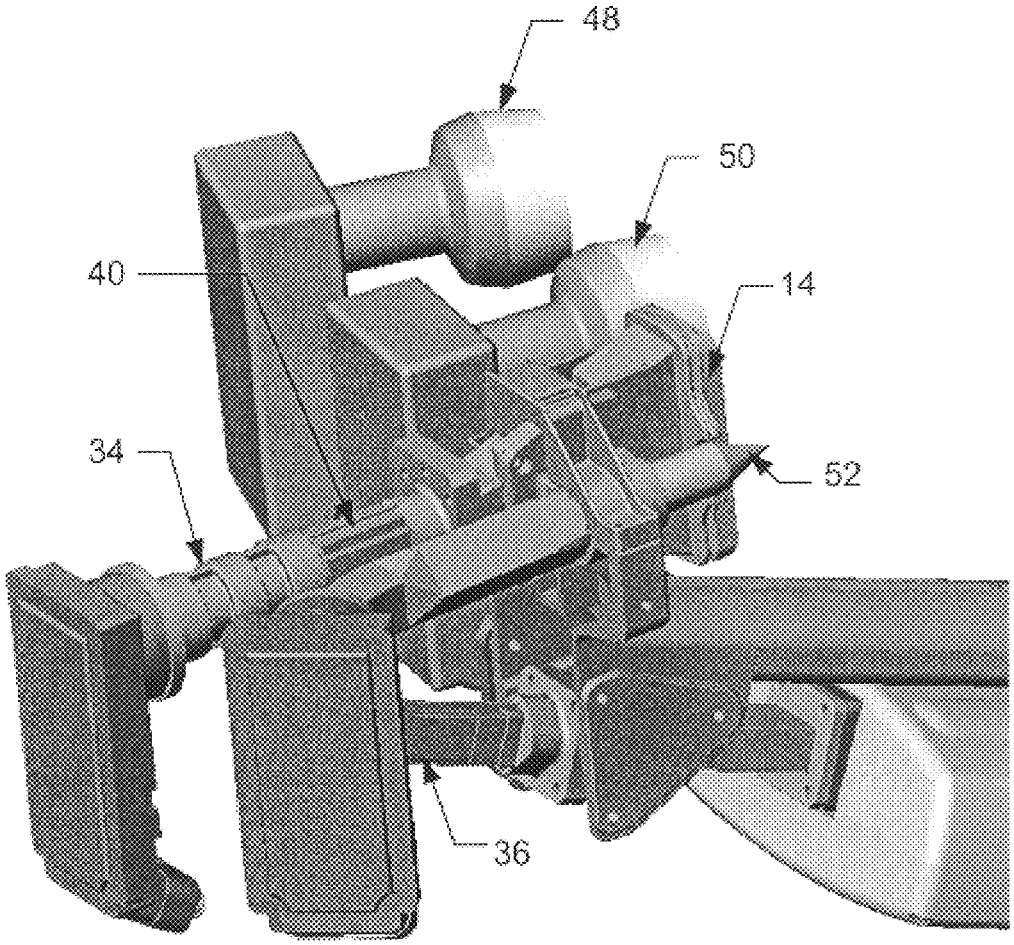

FIGS. 5A and 5B are perspective views of an antenna that incorporates a support structure in combination with wave-guides of the present invention according to one embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As discussed above and provided in more detail below, the present invention provides various antennas and wave-guides that overcome many of the identified deficiencies associated with providing an antenna having a compact configuration with decreased moment stress on the antenna structure. Specifically, the present invention provides a novel wave-guide design used for connecting the feed structure of an antenna to various electronics, such as a transmitter or receiver. The wave-guide is constructed such that one end of the wave-guide is connected to the feed structure, while at least a portion of the body of the wave-guide extends toward the reflector of the antenna such that the second end of the wave-guide is closer than the first end of the wave-guide. As such, transmitters, receivers, and other electronics connected to the second end of the feed structure are closer to the reflector of the antenna, thereby providing a more compact design with reduced moment forces on the boom arm and mounting post of the antenna.

As illustrated in FIG. 1, many conventional antenna structures include feed structures that place the transmitter, receiver, and other electronics 20 in an in-line configuration behind the feed 14. This in-line configuration may result in an enlarged component packaging for the antenna and may also increase the moment forces on the boom arm 18 and mounting post 16 of the antenna. With reference to FIGS. 2A–2F, the present invention provides a wave-guide structured such that it locates the transmitter, receiver, or other electronics associated with the feed in a position proximal to the reflector of the antenna, thereby making the antenna more compact and reducing moment forces on the boom arm and mounting post of the antenna.

Specifically, FIGS. 2A–2F are illustrative embodiments showing in general terms the various configurations that can be achieved by the wave-guide, support structure, and antenna of the present invention. These configurations have one common goal in mind, and that is to make the antenna of the present invention more compact by positioning either one or both of the transmitter and receiver of the antenna in close proximity to the reflector of the antenna. This has the added collateral effect of reducing the moment forces on the boom arm and mounting post of the antenna. It must be understood that FIGS. 2A–2F are merely illustrated figures showing the general configurations of the wave-guide and that the present invention is not limited to the structure shown or the configurations shown.

FIG. 2A illustrates a first embodiment of the present invention, in which a wave-guide of the present invention is configured such that the transmitter or receiver connected to the wave-guide is positioned toward the reflector of the antenna and below the position of the feed. Specifically, similar to conventional antennas, such as the one illustrated in FIG. 1, the antenna 22 of the present invention includes a reflector 12 for directing signals from a satellite to a feed 14 and/or signals from the feed to a satellite. The antenna of the present invention further includes a mounting post 16 for anchoring the antenna to a stationary structure and a boom arm 18 connecting the feed 14 to the reflector and/or mounting post of the antenna. Further, the antenna of the present invention includes electronics 20, such as a transmitter or receiver connected to the feed.

As illustrated, the antenna of the present invention further includes a wave-guide 24 connected between the feed 14 and the electronics 20. The wave-guide includes a first end 26 connected to the feed and a second end 28 connected to the electronics. When this wave-guide is used as a receive wave-guide, it is connected between the feed and the receiver of the antenna to provide signals received by the feed to the electronics, and when used as a transmit wave-guide, the wave-guide is connected between the feed and the transmitter of the antenna to provide signals from the transmitter to the feed for transmission.

Importantly, as illustrated, the body of the wave-guide is configured such that the second end of the wave-guide is directed downwardly toward the reflector. Specifically, the second end 28 of the wave-guide is located closer to the reflector than the first end 26 of the wave-guide. As the electronics 20 are connected to the second end of the wave-guide, the electronics are also positioned toward the reflector. Because the second end of the wave-guide is located at a position that is closer to the reflector than the first end of the wave-guide, at least a portion of the electronics associated with the feed are also located more proximal to the reflector than the first wave-guide, thereby placing the electronics in a compact form. In other words, the distance D between the reflector 12 and the distal portion of the antenna opposite the reflector has decreased due to the placement of the transmitter and/or receiver electronics closer to the reflector using the wave-guide of the present invention. This, in turn, makes the antenna of the present invention more compact. Also, because the distance D has decreased, the moment force M on the end of the boom arm has also decreased.

As discussed, the body of the wave-guide of the present invention extends towards the reflector such that the second end of the wave-guide is closer to the reflector than the first end of the wave-guide. This aspect of the present invention may be better understood by discussing the planes defined by the ends of the wave-guide. Specifically, with reference to FIG. 2A the feed 14 has a proximal end directed at the reflector and a distal end directed away from the reflector, and the first end 26 of the wave-guide is connected to the distal end of the feed 14. Importantly, the first end 26 of wave-guide has an end surface oriented toward the reflector for connecting to the distal end of the feed. This end surface defines a plane, which is spaced forwardly of the reflector 12. In this embodiment, the body of the wave-guide extends towards the reflector such that the second end 28 projects beyond this plane P. In a further, embodiment, both the second end 28 of the wave-guide and at least a portion of the body of the wave-guide extend past the plane P.

With reference to FIGS. 2B and 2C, two more general embodiments of the present invention are illustrated. These embodiments of the present invention illustrate that not only can the wave-guide 24 of the present invention be formed to extend downwardly toward the reflector 12 of the antenna, it can extend along any axis in a direction toward the reflector. Specifically, FIG. 2C illustrates the wave-guide 24 of the present invention extending upwardly and in a direction toward the reflector, and FIG. 2B illustrates the wave-guide 24 of the present invention extending from a side in a direction toward the reflector of the antenna.

Now with reference to FIG. 2D a preferred embodiment of the present invention is illustrated. As shown in FIGS. 2A–2C, in some configurations, the electronics 20 of the antenna are connected to the second end of the wave-guide 24 of the present invention, and the wave-guide supports the weight of the electronics. Due to the weight, complexity, and cost associated with electronics such as a transmitter or receiver, it may in some embodiments, be advantageous to further support the electronics 20 of the antenna such that the strain placed on the wave-guide by the weight of the electronics is minimized. Further, additional support may be warranted to ensure that the electronics does not move significantly due to vibrations or other shock forces subjected to the antenna, such as during installation of the antenna, a wind storm, or other inclement weather.

In light of this, in one embodiment of the present invention, the electronics 20 are connected to the boom arm 18 of the antenna. In this configuration, the first end 26 of the wave-guide is connected to the feed 14 and the second end 28 of the wave-guide of the present invention extends toward the reflector until it connects with the electronics 20 at a point closer to the reflector than the first end of the wave-guide. As such, in this embodiment, the electronics receive added support from the connection to the boom arm, while the wave-guide of the present invention provides a connection to the feed 14 of the antenna. This embodiment of the present invention is further illustrated in FIGS. 4A, 5A, and 5B below.

The embodiments discussed above illustrate use of the wave-guide of the present invention as either a receive or transmit wave-guide, dependent on whether the feed 14 is used to transmit or receive data. In addition to these embodiments, the wave-guide of the present invention may also be used with feed structures capable of both transmitting and receiving signals simultaneously. Specifically, in some satellite communication applications, two-way communication is required. For example, some satellites are used for Internet data transmission and telephone communication. In these instances, the antenna used for communicating with these satellites must both receive signals from and transmit signals to the satellite. In order to accomplish two-way communication with a single feed, a support structure is employed for connecting both the transmitter and receiver of the antenna to the common feed.

This support structure is typically an ortho-mode transducer (OMT). An OMT has a central body structure that allows for propagation of both polarizations of a signal. In this configuration, the transmitter will transmit signals to the satellite in one polarization and the receiver will receive signals from the satellite in the opposite polarization. The OMT is connected to the feed of the antenna and allows signals received at one polarization to propagate to a receiver port to which the receiver of the antenna is connected. Further, signals at the opposite. polarization that are input into a transmitter port of the OMT by the transmitter are provided to the feed for transmission.

In instances in which a feed is used in conjunction with an OMT to both transmit and receive, the present invention provides two wave-guides; one connected between the receive port of the OMT and a receiver of the antenna and another connected between the transmit port of the OMT and the transmitter. An example of the connections of the wave-guides of the present invention to an OMT according to one embodiment of the present invention is illustrated in FIG. 3. Specifically, FIG. 3 is a cross-sectional view of an OMT 40 having a port 42 for connection to a feed, a transmit port 44 for connection to a transmitter, and a receive port 46 for connection to a receiver. Connected to the transmit port of the OMT is a transmit wave-guide 36, according to one embodiment of the present invention, for connection to a transmitter, not shown. Further, a receive wave-guide 34 according to one embodiment of the present invention is connected to the receive port of the OMT for connecting the OMT to a receiver, not shown.

With reference to FIGS. 2E and 2F, two embodiments using the wave-guide of the present invention in conjunction with a support structure such as an OMT are illustrated. These figures illustrate that either one or both of the wave-guides can be configured to place the electronics associated with them in a position that is proximate to the reflector antenna. Specifically, FIG. 2E illustrates an embodiment in which only one of the wave-guides has been configured to position the electronics proximate to the reflector. In this particular embodiment, the transmit wave-guide 36 according to one embodiment of the present invention is configured such that the first end of the wave-guide is connected to the OMT 40, while the second end of the wave-guide 36 is extended toward the reflector to a position closer to the reflector than the first end of the wave-guide, such that the transmitter 30 connected to the transmit wave-guide is positioned proximate to the reflector of the antenna. In this embodiment, the receive wave-guide 34 and receiver 32 are positioned behind the feed in an in-line configuration.

FIG. 2F is similar to the previous embodiment, however, in this particular embodiment of the present invention, both the receive and transmit wave-guides, 34 and 36, are extended toward the reflector, such that both the transmitter 30 and the receiver 32 are located proximate to the reflector of the antenna.

Although FIGS. 2E and 2F illustrate the transmit wave-guide 36 of the present invention extending toward the reflector, it must be understood that the receiver wave-guide 34 could be arranged similar to transmit wave-guide in an alternative embodiment, such that the receive wave-guide 34 is connected to the bottom of the support structure 40 and the transmit wave-guide 36 is positioned at the back of the support structure 40.

As stated, FIGS. 2E and 2F illustrate embodiments where the feed is used for both transmitting and receiving data and is connected to the transmitter and receiver of the antenna by a support structure, such an OMT, and wave-guides. To further illustrate this aspect of the present invention FIGS. 4A and 4B respectively illustrate the two wave-guide configurations of FIGS. 2E and 2F. Specifically, FIG. 4A illustrates an embodiment in which the feed 14 is connected to the support structure 40 and a receive 34 and transmit 36 wave-guides are connected to the ports of the support structure. As can be seen, the transmit wave-guide of this embodiment is configured to position the transmitter, not shown, of the antenna in a position proximate to the reflector.

Similarly, FIG. 4B illustrates the configuration of a feed system according to the embodiment of the present invention illustrated in FIG. 2F. Similar to the previous embodiment, the feed 14 is connected to a support structure 40, such as an OMT, and the receive 34 and transmit 36 wave-guides are connected to the ports of the support structure. As can be seen, in this embodiment, both the receive and transmit wave-guides are configured to position the receiver and transmitter, not shown, of the antenna in a position proximate to the reflector.

As discussed in the various embodiments above, the wave-guide of the present invention is connected at a first end to the feed and has a second end that extends toward the reflector of the antenna. Importantly, the second end of the feed is positioned such that it is closer to the reflector than the first end of the feed. This, in turn, allows the electronics connected to the second end of the wave-guide to be placed in close proximity to the reflector of the antenna. As illustrated in these various embodiments, the configuration of the wave-guide of the present invention may take many different forms depending on the configuration the antenna and the electronics.

For example, FIG. 4B illustrates a transmit wave-guide 36 according to one embodiment having first 36*a* and second 36*b* body portions connected by a bend 36*c*. The first body portion 36*a* extends generally along an axis that is at an offset angle $\alpha$ from the horizontal axis of the feed 14. Further, the second body portion 36*b* extends along a second axis that is an offset angle $\beta$ of the axis of extension of the first body portion. This configuration is used in some embodiments where the electronics associated with the wave-guide is connected to the boom arm. It must be understood that the offset angles of the extension of the first and second body portions are typically arbitrary and are mainly chosen to make proper connection with the electronics, ensure the strength of the wave-guides, and the performance of the wave-guides. However, in typical embodiments, the first offset angle $\alpha$ of extension of the first body portion is typically less than 90 degrees and the second offset angle $\beta$ is in the range of greater than 0 but less than 180 degrees.

FIG. 4B also illustrates. an alternative configuration for the wave-guide of the present invention. Specifically, FIG. 4B further illustrates two circular receive wave-guides 34 connected to the two illustrated feeds. As can be seen these receive wave-guides include several bends to place the receiver in a compact position. Further, FIG. 4A illustrates another embodiment of the transmit wave-guide 36 that is also in a curved configuration.

FIGS. 4A, 5A, and 5B illustrate a perspective embodiment of the wave-guide and antenna configuration of the present invention. Specifically, these figures illustrate an embodiment in which wave-guides, 34 and 36, of the present invention are connected to a support structure 40, such as an OMT, which, in turn, is connected to a feed 14. This embodiment of the present invention is similar to the illustrative embodiment shown in FIG. 2F. Specifically, FIGS. 4A, 5A, and 5B illustrate a multibeam antenna having a plurality of feeds, 14, 48, 50, 52, positioned relative to a reflector 12 to communicate with different satellites. Importantly, the transmit wave-guide 36 for the feed 14 is formed such that a first end of the wave-guide is connected to the feed via the support structure 40 and the second end of the wave-guide is directed toward the reflector of the antenna. Further, the transmitter 30 of the antenna is connected to the boom arm 18. Further, as with the embodiment shown in FIG. 2F, the receive wave-guide 34 of this embodiment extends in a in-line configuration behind the feed 14 and is connected to a receiver 32 such as a low noise block.

As discussed and illustrated above, the present invention provides various configurations for forming of the wave-guides of the present invention and place of the electronics associated with an antenna. It must be understood that above discussion is not exhaustive, but instead, is an illustrative example of the some of the configurations of the invention. As such, the wave-guide and antenna of the present invention should not be limited by the embodiments illustrated herein.

Additionally, throughout the description, the receiver electronics is sometimes referred to as the receiver. It must be understood that the receiver electronics connected to the second end of the wave-guide may not be the actual receiver, but instead may be signal processing electronics, such as a low noise block, connected between the wave-guide and the receiver for filtering and amplifying signals prior to application to the receiver.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An antenna for transmitting and/or receiving signals, comprising:

a reflector that directs signals transmitted to or from the antenna;

a feed mounted forwardly of said reflector and directed at the reflector for receiving or transmitting signals, wherein said feed has a proximal end directed at the reflector of the antenna and a distal end directed away from the reflector;

a support stricture having a first port communicatively connected to said feed and having a second port, and wherein said first port of said support structure has an end surface oriented toward the reflector for connecting to the distal end of said feed, said end surface defining a plane which is spaced forwardly of the reflector; and a wave-guide comprising a body having a first end connected to said second port of said support structure and a second end connected to an electronic signal transmitting or receiving component, wherein at least a portion of said wave-guide body extends towards the reflector, wherein said extending portion of said wave-guide body which extends towards the reflector projects beyond said plane, and wherein said extending portion extends along a first axis of extension at an offset angle that is less than 90 degrees with respect to an axis extending between the proximal and distal ends of said feed.

2. An antenna according to claim 1, wherein the feed has a proximal end directed at the reflector and a distal end directed away from the reflector, and wherein said body of said wave-guide comprises:

a first body portion connected to the feed by said first end of said wave-guide and having a first axis of extension such that said first body portion extends from said first end of said wave-guide at a first offset angle that is less than 90 degrees with respect to an axis extending between the proximal and distal ends of the feed;

a second body portion having a second axis of extension that extends at a second offset angle from the first axis of extension of said first body portion towards the reflector of the antenna; and a bend portion between said first and second body portions.

3. An antenna according to claim 2, wherein said second body portion of said wave-guide has a second axis of extension extending at a second offset angle from the first axis of extension of said first body portion toward the reflector of the antenna at an offset angle with respect to the first axis of extension of said first body portion in the range of greater than 0 degrees and less than 180 degrees.

4. An antenna according to claim 1, wherein said wave-guide is a receive wave-guide having a first end connected to the feed and a second end connected to a receiver, and wherein said second end of said wave-guide extends in a direction towards the reflector of the antenna to minimize distance that the receiver extends from the reflector.

5. An antenna according to claim 1, wherein said wave-guide is a transmit wave-guide having a first end connected to the feed and a second end connected to a transmitter, and wherein said second end of said wave-guide extends in a direction towards the reflector of the antenna to minimize a distance that the transmitter extends from the reflector.

6. An antenna according to claim 1, wherein said support structure is an ortho-mode transducer capable of receiving signals from and providing transmit signals to said feed and includes a third port for communication with a receiver.

7. An antenna according to claim 6, wherein said wave-guide includes a transmit wave-guide section communicatively connected to the second port of said support structure and a receive wave-guide section communicatively connected to the third port of said support structure, and wherein at least one of said transmit wave-guide section and receive wave-guide section extends in a direction towards the reflector of the antenna such that said second end of said wave-guide is closer to the reflector than said first end of said wave-guide.

8. An antenna according to claim 7, wherein both said transmit wave-guide section and said receive wave-guide section include portions which extend in a direction towards the reflector of the antenna.

9. An antenna according to claim 8, further comprising at least one boom arm connected between said reflector and said support structure and a transmitter positioned on said boom arm, wherein at least a portion of said body of said wave-guide extends in a direction toward the reflector of the antenna, such that said second end of said wave-guide is connected to the transmitter.

10. An antenna according to claim 8, further comprising at least one boom arm connected between said reflector and said support structure and a receiver positioned on said boom arm, wherein at least a portion of said body of said wave-guide extends in a direction toward the reflector of the antenna, such that said second end of said wave-guide is connected to the receiver.

11. A wave-guide for coupling an electronic signal transmitting or receiving component to a feed directed at a reflector of an antenna, wherein the feed has a proximal end directed at the reflector of the antenna and a distal end directed away from the reflector or the antenna, wherein said wave-guide comprises a body having a first end for connection to the feed aid a second end for connection to one of a transmitter and a receiver, wherein at least a first body portion of said body of said wave-guide extends in a direction towards the reflector of the antenna, and wherein said first body portion extends along a first axis of extension at an offset angle that is less than 90 degrees with respect to an axis extending between the proximal and distal ends of the feed.

12. A wave-guide according to claim 11, wherein said body of said wave-guide further comprises:

a second body portion having a second axis of extension that extends at a second offset angle from the first axis of extension of said first body portion towards the reflector of the antenna; and a bend portion between said first and second body portions.

13. A wave-guide according to claim 12, wherein said second body portion of said wave-guide has a second axis of extension extending at a second offset angle from the first axis of extension of said first body portion toward the reflector of the antenna at an offset angle with respect to the first axis of extension of said first body portion in the range of greater than 0 degrees and less than 180 degrees.

14. A wave-guide according to claim 11, wherein said wave-guide is a receive wave-guide having a first end configured for connection to the feed and a second end configured for connection to a receiver, and wherein said second end of said wave-guide extends in a direction towards the reflector of the antenna to minimize distance that the receiver extends from the reflector.

15. A wave-guide according to claim 11, wherein said wave-guide is a transmit wave-guide having a first end configured for connection to the feed and a second end for connection to a transmitter, and wherein said second end of said wave-guide extends in a direction towards the reflector of the antenna to minimize a distance that the transmitter extends from the reflector.

16. An antenna for transmitting and/or receiving signals, comprising;

a reflector that directs signals transmitted to or from the antenna;

a feed mounted forwardly of said reflector and directed at the reflector for receiving or transmitting signals;

a support structure leaving a first port communicatively connected to said feed and second and third ports, at least one boom arm connected between said reflector and said support structure;

a receiver connected to said second port of said support structure, wherein said receiver extends outwardly from said support structure in a direction away from said reflector;

a transmitter connected directly to said boom arm;

a unitary transmit wave-guide comprising a body formed of one piece having a first end connected to said second port of said support structure, wherein at least a portion of said body of said transmit wave-guide extends in a direction toward the reflector of the antenna, such that a second end of said transmit wave-guide is connected to the transmitter connected to the boom arm; and a unitary receive wave-guide comprising a body formed of one piece having a first end connected to said second port of said support structure and a second end connected to said receiver.

17. An antenna according to claim 16, wherein the feed has a proximal end directed at the reflector of the and a distal end directed away from the reflector, and wherein said first port of said support structure has an end surface oriented toward the reflector for connecting to table distal end of the feed, said end surface defining a plane which is spaced forwardly of the reflector, and wherein said portion of said transmit wave-guide body which extends towards the reflector projects beyond said plane.

18. An antenna according to claim 17, wherein the feed has a proximal end directed at the reflector and a distal end directed away from the reflector, and wherein said portion of said transmit wave-guide body which projects beyond said plane extends along an axis of extension at an offset angle that is less than 90 degrees with respect to an axis extending between the proximal and distal ends of said feed, such that said second end of said transmit wave-guide is directed toward the reflector of the antenna.

19. An antenna according to claim 16, wherein said support structure is an ortho-mode transducer capable of receiving signals form and providing transmit signals to said feed.

* * * * *

UNITED STATES PATENT AND TRADEMARK OFFICE

CERTIFICATE OF CORRECTION

PATENT NO. : 6,417,815 B2
DATED : July 9, 2002
INVENTOR(S) : Moheb

It is certified that error appears in the above-identified patent and that said Letters Patent is hereby corrected as shown below:

Title page,
Item [56], References Cited, U.S. PATENT DOCUMENTS, "Kimoshita et al." should read -- Kinoshita et al. --.

Column 10,
Line 57, "stricture" should read -- structure --.

Column 12,
Line 12, after reflector, "or" should read -- of --;
Line 14, after feed, "aid" should read -- and --;
Line 57, "leaving" should read -- having --.

Column 13,
Line 14, "table" should read -- the --.

Signed and Sealed this

Tenth Day of December, 2002

JAMES E. ROGAN
*Director of the United States Patent and Trademark Office*